US011199074B2

(12) United States Patent
Steele

(10) Patent No.: US 11,199,074 B2
(45) Date of Patent: Dec. 14, 2021

(54) ACTUATOR FOR MULTILATERAL WELLBORE SYSTEM

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/094,432

(22) PCT Filed: Nov. 17, 2017

(86) PCT No.: PCT/US2017/062405

§ 371 (c)(1),
(2) Date: Oct. 17, 2018

(87) PCT Pub. No.: WO2019/099037

PCT Pub. Date: May 23, 2019

(65) Prior Publication Data

US 2021/0010350 A1 Jan. 14, 2021

(51) Int. Cl.
*E21B 41/00* (2006.01)
*E21B 23/12* (2006.01)
(Continued)

(52) U.S. Cl.
CPC ..... *E21B 41/0035* (2013.01); *E21B 23/00* (2013.01); *E21B 23/12* (2020.05);
(Continued)

(58) Field of Classification Search
CPC ..... E21B 41/0042; E21B 23/12; E21B 34/14; E21B 2200/06; E21B 43/305;
(Continued)

(56) References Cited

U.S. PATENT DOCUMENTS 5,730,224 A 3/1998 Williamson et al.
6,095,248 A 8/2000 Freeman
(Continued)

FOREIGN PATENT DOCUMENTS

RU 2239041 C2 10/2004
RU 2588999 C2 7/2010
RU 2531955 C2 10/2014

OTHER PUBLICATIONS

International Search Report and Written Opinion for PCT/US2017/062405 dated Aug. 14, 2018.
(Continued)

*Primary Examiner* — Nicole Coy
(74) *Attorney, Agent, or Firm* — Scott Richardson; C. Tumey Law Group PLLC

(57) ABSTRACT

A lateral wellbore access system is used for moving an isolation sleeve relative to a window of a completion sleeve to adjust access through the window. The system includes an actuator having an isolation sleeve coupling mechanism and a driving mechanism. The isolation sleeve coupling mechanism is configured to engage with an isolation sleeve. The driving mechanism is configured to longitudinally reciprocate the isolation sleeve coupling mechanism within a bore of a completion sleeve to longitudinally move an isolation sleeve coupled to the isolation sleeve coupling mechanism within the bore relative to a window of the completion sleeve. Movement of the isolation sleeve adjusts a position of the isolation sleeve relative to the completion sleeve window for permitting or blocking access through the window into the bore.

20 Claims, 6 Drawing Sheets

(51) Int. Cl.
*E21B 34/14* (2006.01)
*E21B 23/00* (2006.01)

(52) U.S. Cl.
CPC ..... *E21B 34/14* (2013.01); *E21B 41/0042* (2013.01); *E21B 2200/06* (2020.05)

(58) Field of Classification Search
CPC ..... E21B 41/0035; E21B 23/00; E21B 34/06; E21B 41/00
See application file for complete search history.

(56) References Cited

U.S. PATENT DOCUMENTS 6,244,340 B1 6/2001 McGLothen et al.
7,762,324 B2 * 7/2010 Clem ..... E21B 43/045 166/177.5
8,157,016 B2 * 4/2012 James ..... E21B 23/04 166/375
8,316,937 B2 11/2012 Cronley et al.
8,459,345 B2 6/2013 Bell
8,813,840 B2 8/2014 Zupanick
9,238,949 B2 * 1/2016 Dancer ..... E21B 7/061
10,557,331 B2 * 2/2020 Rodriguez ..... E21B 41/0042
10,724,344 B2 * 7/2020 Dietz ..... E21B 7/061
2005/0139362 A1 7/2005 Coone et al.
2011/0186291 A1 * 8/2011 Lang ..... E21B 47/024 166/255.2
2012/0138301 A1 7/2012 Assal et al.
2012/0241144 A1 9/2012 Bell
2014/0008130 A1 1/2014 Dancer et al.
2014/0034298 A1 2/2014 Donovan
2014/0124198 A1 5/2014 Donovan

OTHER PUBLICATIONS

"Six Zone Intelligent Completion Installation Benefits and Lessons Learned Before Production in Offshore Indonesia" Jugdaw et al. dated 2013.
Internal Control Valve datasheet, Halliburton, dated 2017.
Russian Office Action with Partial English Translation for Application No. 2020113638 dated Dec. 8, 2020.

* cited by examiner

ACTUATOR FOR MULTILATERAL WELLBORE SYSTEM

TECHNICAL FIELD

The present description relates in general to multilateral wellbore operations, and more particularly to, for example, without limitation, an actuator for shifting an isolation sleeve for multilateral wellbore operations.

BACKGROUND OF THE DISCLOSURE

In the oil and gas industry, hydrocarbons are produced from wellbores traversing subterranean hydrocarbon producing formations. Many current well completions include more than one wellbore. For example, a first, generally vertical wellbore may be initially drilled within or adjacent to one or more hydrocarbon producing formations. Any number of additional wellbores may then be drilled extending generally laterally away from the first wellbore to respective locations selected to optimize production from the associated hydrocarbon producing formation or formations. Such well completions are commonly referred to as multilateral wells.

A typical multilateral well completion includes a primary wellbore defined in part by a string of casing and cement disposed between the casing and the inside diameter of the primary wellbore. The primary wellbore extends from the well surface to a desired downhole location, and directional drilling equipment and techniques may then be used to form one or more exits or windows from the primary wellbore through the casing and cement at predetermined locations and subsequently drill one or more corresponding secondary wellbores that extend from the primary wellbore. For many well completions such as deep offshore wells, multiple secondary wellbores will be drilled from each primary wellbore in an effort to optimize hydrocarbon production while minimizing overall drilling and well completion costs.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Some embodiments disclosed herein provide actuators and methods for shifting an isolation sleeve during multilateral wellbore operations.

Selective isolation and/or reentry into each of the secondary wellbores is often necessary to optimize production from the associated hydrocarbon producing formations. A typical multilateral well completion will have a reentry window assembly (alternately referred to as a lateral reentry window or lateral wellbore access system) installed within the primary wellbore at the junction between the primary wellbore and each secondary wellbore. Each reentry window assembly includes a window that provides access into the secondary wellbore from the primary wellbore. In order to block access through the window and/or to prevent fluid flow through the window, an isolation sleeve must be lowered into the primary wellbore and fitted within the reentry window assembly in a position to block the window. Thereafter, to permit access through the window and allow entry into the secondary wellbore, the isolation sleeve must be located and removed from within the reentry window assembly to expose the window. Conventionally, these isolation sleeves must be completely removed from the primary wellbore to allow access to the secondary wellbore, requiring rig time to conduct intervention runs to retrieve and re-install conventional isolation sleeves.

According to at least some embodiments disclosed herein is the realization that the number of required intervention trips into a multilateral well can be reduced by using a system that includes an actuator for shifting an isolation sleeve without requiring the isolation sleeve to be completely removed or otherwise manipulated using tools from the surface. Further, according to at least some embodiments disclosed herein is the realization that by including an actuator for shifting an isolation sleeve, the size of the opening through the window can be precisely controlled to regulate the amount of flow from the lateral or secondary wellbore in the multilateral well.

Figure 1:
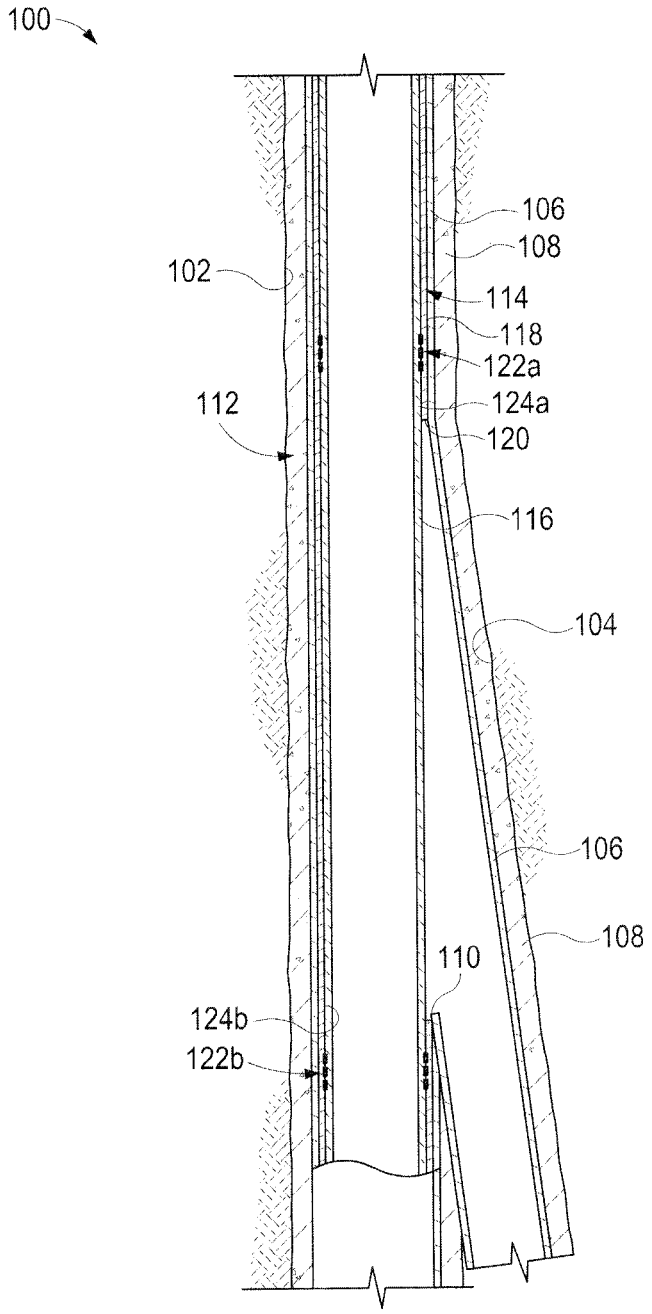
FIG. 1 is a cross-sectional view of an exemplary well system that may incorporate the principles of the present disclosure.

FIG. 1 is a cross-sectional view of an exemplary well system that may be incorporate the principles of the present disclosure. As illustrated, the well system 100 may include a primary wellbore 102 and a secondary wellbore 104 that extends at an angle from the primary wellbore 102. The primary wellbore 102 can alternately be referred to as a parent wellbore, and the secondary wellbore 104 can be referred to as a lateral wellbore. While only one secondary wellbore 104 is depicted in FIG. 1, it will be appreciated that the well system 100 may include multiple secondary (lateral) wellbores 104 extending from the primary wellbore 102 at various locations. Likewise, it will be appreciated that the well system 100 may include multiple tertiary (twig) wellbores (not shown) extending from one or more of the secondary wellbores 104 at various locations. Accordingly, the well system 100 may be characterized and otherwise referred to as a "multilateral" wellbore system.

A liner or casing 106 may line each of the primary and secondary wellbores 102, 104 and cement 108 may be used to secure the casing 106 therein. In some embodiments, however, the casing 106 may be omitted from the secondary wellbore 104, without departing from the scope of the disclosure. In other embodiments, the cement 108 may be omitted from the secondary wellbore 104, without departing from the scope of this disclosure. The primary and secondary wellbores 102, 104, may be drilled and completed using conventional well drilling techniques. A casing exit 110 may be milled, drilled, or otherwise defined along the casing 106 at the junction between the primary and secondary wellbores 102, 104. The casing exit 110 generally provides access for downhole tools to enter the secondary wellbore 104 from the primary wellbore 102.

In the illustrated embodiment, the well system 100 has been completed by installing a reentry window assembly 112, also referred to as a lateral wellbore access system, in the primary wellbore 102. The reentry window assembly 112 includes a completion sleeve 114 and an isolation sleeve 116 longitudinally movably positioned within a bore of the completion sleeve 114. As illustrated, the completion sleeve 114 is able to be positioned within the primary wellbore 102 and provides a generally cylindrical body 118 with a longitudinal axis that axially spans the casing exit 110. The completion sleeve 114 may be arranged within the primary wellbore 102 such that a window 120 defined to provide access to the bore of the completion sleeve 114 azimuthally and angularly aligns with the casing exit 110 and thereby provides access into the secondary wellbore 104 from the primary wellbore 102. In some embodiments, the completion sleeve 114 can include packers, or other sealing devices, disposed at either end of the isolation sleeve 116 to seal off the annulus defined by the completion sleeve 114 and the primary wellbore 102. Packers or other sealing devices can work in conjunction with the isolation sleeve 116 to prevent flow to and/or from the secondary wellbore 104 to the primary wellbore 102.

Figure 2:
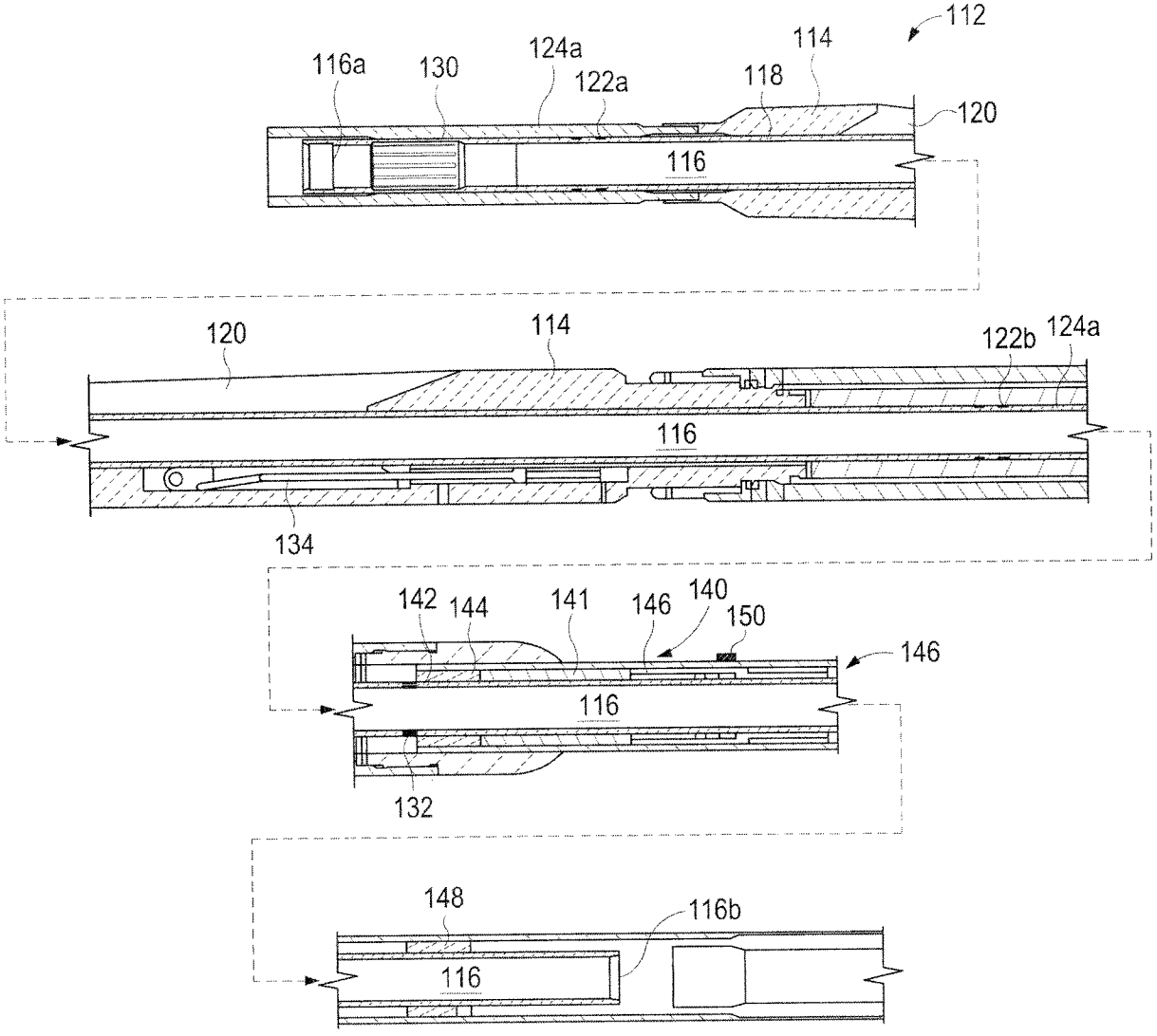
FIG. 2 is a cross-sectional side view of an exemplary reentry window assembly, according to some embodiments.

FIG. 2 is a cross-sectional side view of an exemplary reentry window assembly according to some embodiments of the present disclosure. More particularly, FIG. 2 depicts successive portions of the reentry window assembly 112. Similar reference numerals used in prior figures will refer to similar elements or components that may not be described again in detail.

In some embodiments, the isolation sleeve 116 may be positioned within the body 118 of the completion sleeve 114 and may comprise a generally tubular or cylindrical structure that is axially movable within the completion sleeve 114 between a first or "fully closed" position, a second or "fully open" position, or any position therebetween.

In some embodiments, as in the example of FIG. 2, the reentry window assembly 112 can optionally include a set of upper seals 122*a* and a set of lower seals 122*b* to seal between the completion sleeve 114 and the isolation sleeve 116. The upper seals 122*a* and the lower seals 122*b* are optionally carried on the isolation sleeve 116. The upper seals 122*a* may sealingly engage an upper seal bore 124*a* provided on the inner surface of the body 118, and the lower seals 122*b* may sealingly engage a lower seal bore 124*b* provided on the inner surface of the body 118. As illustrated, the upper and lower seal bores 124*a*, 124*b* are located adjacent opposing axial ends of the window 120. Accordingly, when in the first position, the isolation sleeve 116 may provide fluid isolation between the primary and secondary wellbores 102, 104.

According to some embodiments, the isolation sleeve 116 can be axially translated by an actuator 140. In some embodiments, the actuator 140 can be disposed at an uphole location relative to the isolation sleeve 116. In some embodiments, the actuator 140 can be disposed at a downhole location relative to the isolation sleeve 116.

In some embodiments, the isolation sleeve 116 is releasably attached to the actuator 140 via an isolation sleeve coupling mechanism 142 to allow the isolation sleeve 116 to be released and move independently from the actuator 140.

In some embodiments, the isolation sleeve coupling mechanism 142 can be coupled to the piston 146 (which can also operate as part of a driving mechanism) via body 141 to move with the piston 146. The isolation sleeve coupling mechanism 142 can be any mechanism to couple the isolation sleeve 116 to the actuator 140 to allow the isolation sleeve 116 to be moved by the driving mechanism of the actuator 140. The driving mechanism of the actuator 140 can be any mechanism that provides movement to the actuator 140 and/or provides movement to the isolation sleeve 116. The isolation sleeve coupling mechanism 142 can mate with an outer profile 132 of the isolation sleeve 116. For example, the isolation sleeve coupling mechanism 142 can be a latch key assembly that mates with the outer profile 132. In some embodiments, the outer profile 132 can comprise a collet or collet mechanism.

More particularly, the isolation sleeve coupling mechanism 142 may include a selective latch key with a unique profile design that selectively locates and engages the outer profile 132. In some embodiments, the isolation sleeve coupling mechanism 142 may be spring-loaded and thereby able to snap into and out of engagement with the outer profile 132 under sufficient axial load. In some embodiments, the isolation sleeve coupling mechanism 142 can have a unique outer profile design that permits the isolation sleeve coupling mechanism 142 to bypass outer profiles of other isolation sleeves that do not match the unique pattern of the outer profile 132. Outer profile 132 and the isolation sleeve coupling mechanism 142 can interface using a plurality of spaced apart grooves, angled shoulders, and/or squared shoulders as described in U.S. Pat. No. 9,140,081. As will be appreciated, this may allow a well operator to employ multiple stacked assemblies 112 within a multilateral well system.

In some embodiments, the isolation sleeve coupling mechanism 142 can be actuated by a power source, including the same power source that is used to shift the isolation sleeve 116. In some embodiments, a unique control signal, a combination of signals and positions, well pressure, etc., can be used to release and/or reengage the isolation sleeve 116. In some embodiments, the isolation sleeve coupling mechanism 142 is electrically actuated.

During operation, an operator may desire to retrieve the isolation sleeve 116 for replacement or servicing. In some embodiments, a retrieval or intervention tool can be deployed downhole to locate the isolation sleeve 116. The retrieval tool can engage an engagement device 130 located at the upper end 116*a* of the isolation sleeve 116. The engagement device 130 can comprise a snap collet that includes a plurality of flexible collet fingers. In some embodiments, the retrieval tool can include spring-loaded dogs or keys that compress when entering the isolation sleeve 116 and expand outwardly to engage a profile of the isolation sleeve 116. In some embodiments, an inner mandrel can slide under the dogs to lock the retrieval tool in place. In other embodiments, however, the engagement device 130 may comprise any type of mechanism capable of releasably engaging a retrieval tool. The isolation sleeve coupling mechanism 142 can release the isolation sleeve 116 from the actuator 140 after a required axial force of the isolation sleeve coupling mechanism 142 is overcome. In some embodiments, the retrieval tool can retain the isolation sleeve 116 in a closed position in the event of power loss to the actuator 140.

According to some embodiments, when the isolation sleeve 116 is coupled to the actuator 140 via the isolation sleeve coupling mechanism 142, the movement of the actuator 140 can move the isolation sleeve 116 to reciprocate the isolation sleeve 116 within the bore of the completion sleeve 114. In some embodiments, the actuator 140 can be a hydraulic actuator, an electromechanical actuator, a pneumatic actuator, etc. In some embodiments, the actuator 140 and other components herein can be electro-hydraulically actuated, wherein electrical lines power a downhole pump and electrically control hydraulics to control the actuator 140. The position of the actuator 140 and the position of the isolation sleeve 116 can be determined and/or controlled using a position sensor 150. In some embodiments, the actuator 140 is a hydraulic actuator with a piston 146 that travels within chambers 147*a*, 147*b* between a first end 144 and a second end 148.

Figure 3:
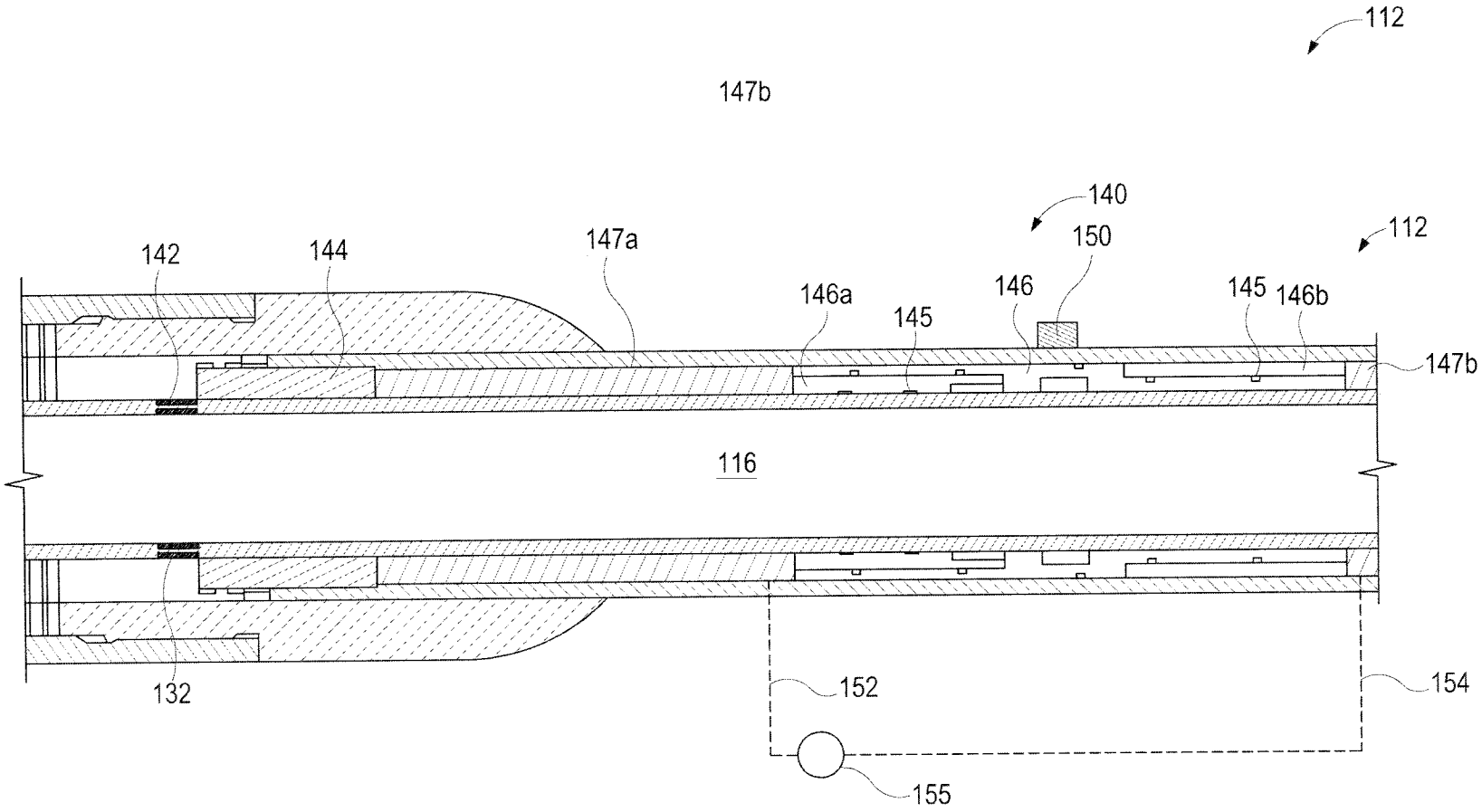
FIG. 3 is a cross-sectional side view of an exemplary actuator, according to some embodiments.

FIG. 3 is a cross-sectional side view of an exemplary actuator according to some embodiments of the present disclosure. In some embodiments, the piston 146 of the actuator 140 is movable in response to hydraulic pressure applied to the surfaces 146*a*, 146*b* of the piston 146. Movement of the piston 146 is transferred to the isolation sleeve 116 via the isolation sleeve coupling mechanism 142.

In some embodiments, the piston 146 is disposed around the isolation sleeve 116 to allow flow and/or access therethrough. The piston 146 can further include seals 145 to seal against the isolation sleeve 116 to maintain pressure within the chambers 147*a*, 147*b*. The seals 145 can be chevron or "V"-shaped seals to allow exposure to pressure to increase sealing.

To axially translate the piston 146 and therefore the isolation sleeve 116, hydraulic pressure can be applied within the chambers 147*a*, 147*b* to the surfaces 146*a*, 146*b* of the piston 146. Hydraulic pressure can be applied from a hydraulic pump 155 via lines 152, 154. In some embodiments, the hydraulic system is a closed system. In some embodiments, the piston 146 can receive hydraulic pressure from hydraulic fluid that is pumped to the actuator 140 and displaced into a return line to the surface or into the well. Displaced fluids can be displaced via the production tubing string or into the annulus of the tubing string.

During operation, hydraulic pressure can be applied from the hydraulic pump 155 to the first chamber 147*a* via the line 152. As hydraulic pressure builds within the chamber 147*a* against the first end 144 and the first surface 146*a*, the piston 146 is urged toward the second end 148, moving the isolation sleeve coupling mechanism 142 towards the second end 148. This movement of the piston 146 can thereby move the isolation sleeve 116 relative to the window 120 to increase the size of the opening through the window 120.

Similarly, hydraulic pressure can be applied from the hydraulic pump 155 to the second chamber 147*b* via the line 154. As hydraulic pressure builds within the chamber 147*b* against the second end 148 and the second surface 146*b*, the piston 146 is urged toward the first end 144, moving the isolation sleeve coupling mechanism 142 towards the first end 144. This movement of the piston 146 can thereby move the isolation sleeve 116 relative to the window 120 to reduce the size of the opening through the window 120 (see FIGS. 4A-4C).

Figure 4A:
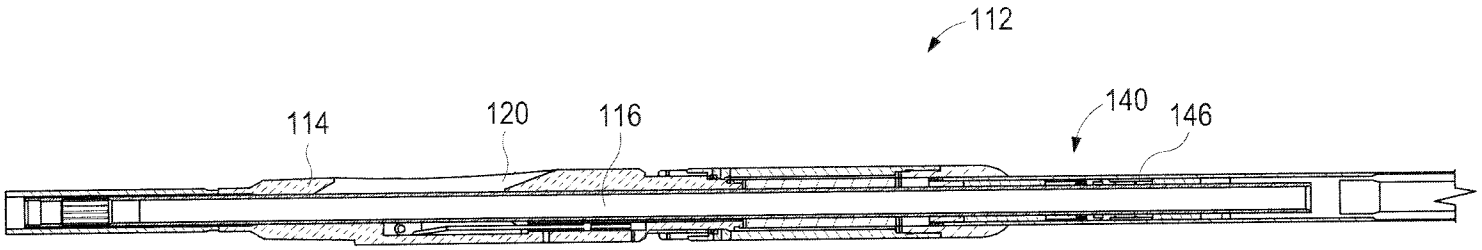
FIGS. 4A-4C are successive cross-sectional side views of the assembly of FIG. 2 in various stages of actuation, according to some embodiments.

According to some embodiments, the movement of the actuator 140 can be used to adjust the amount of overlap of the isolation sleeve 116 with the window 120 to selectively block or allow access to the window 120 of the completion sleeve 114 entirely or partially, at any size opening to regulate the flow of fluid into the production tubing. In some embodiments, movement of the actuator 140 can be used to regulate flow out of the tubing into the lateral wellbore when fluid is to be injected into the wellbore. FIG. 4A is a cross-sectional side view of the assembly of FIG. 2 wherein the isolation sleeve is blocking access to the window. In some embodiments, the isolation sleeve 116 is shown in a first position, wherein the isolation sleeve 116 is occluding the window 120 and thereby prevents access into the secondary wellbore 104 from the primary wellbore 102. As described herein, the isolation sleeve 116 can include seals to provide fluid isolation between the primary and secondary wellbores 102, 104.

Figure 4B:
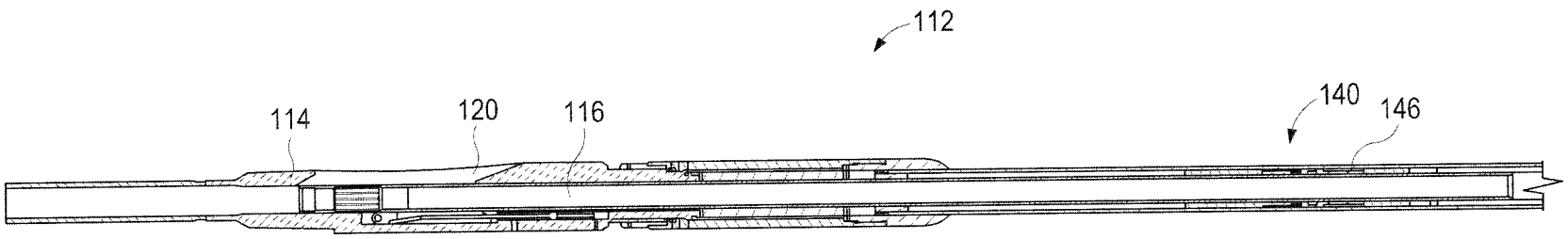

FIG. 4B is a cross-sectional side view of the assembly of FIG. 2 wherein the isolation sleeve is partially blocking access to the window. In some embodiments, hydraulic pressure is applied to the piston 146 to move the piston 146 towards a downhole location. The movement of the piston 146 moves the isolation sleeve 116 downhole to partially allow or block the window 120. In some embodiments, partially blocking the window 120 can be used to allow selective, partial, or controlled flow through a lateral wellbore.

Figure 4C:
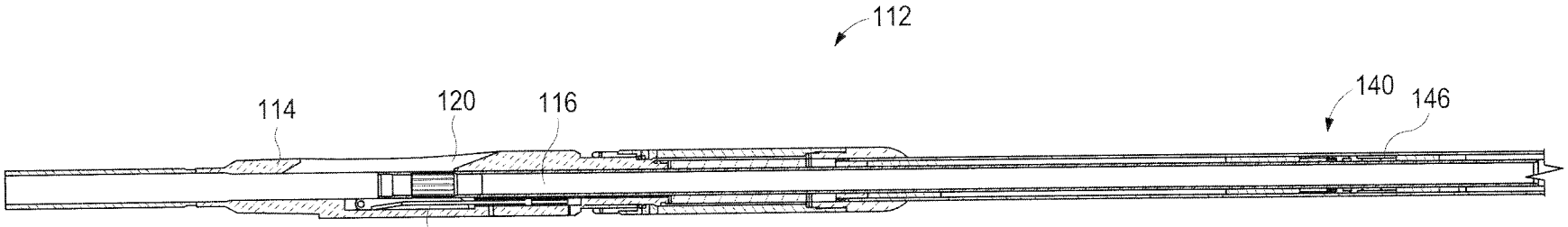

FIG. 4C is a cross-sectional side view of the assembly of FIG. 2 wherein the isolation sleeve is permitting access to the window. In some embodiments, the isolation sleeve 116 is shown in a second position, wherein the isolation sleeve 116 is fully exposing the window 120. In this second position, full access to the lateral wellbore is allowed and any flow or tools are allowed to pass therethrough. In some embodiments, a deflector 134 can be engaged or actuated to direct downhole tools to the secondary wellbore 104 when the isolation sleeve 116 exposes the window 120.

According to some embodiments, the actuator 140 can be utilized to control the position of the isolation sleeve 116 to control the flow to or from the lateral wellbore. The actuator 140 can control the position of the isolation sleeve 116 to partially obstruct the window 120 as shown in FIG. 4B.

Figure 5:
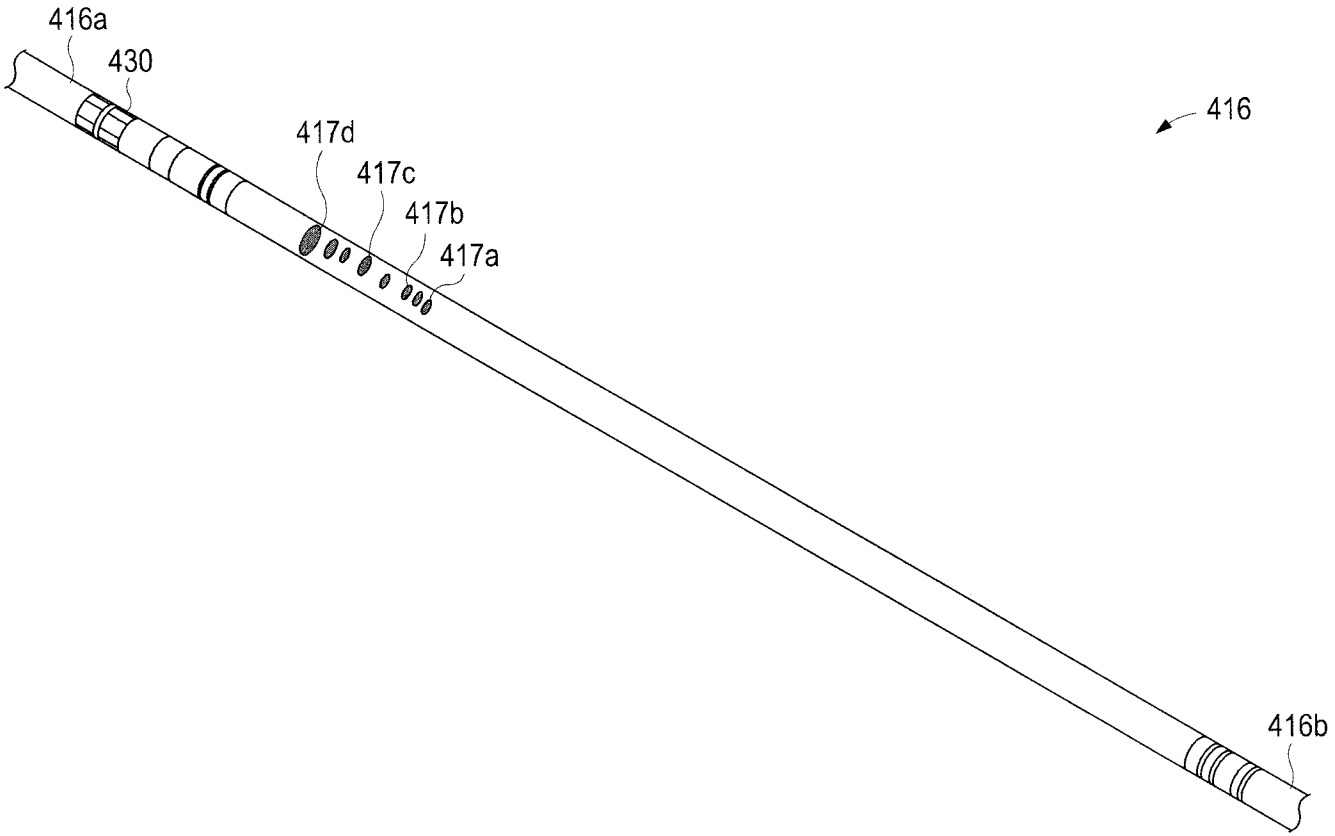
FIG. 5 is an isometric view of an isolation sleeve, according to some embodiments.

Further, according to some embodiments, an isolation sleeve can include flow control orifices to choke or restrict flow as various orifices are exposed to the window 120. FIG. 5 is an isometric view of an isolation sleeve according to some embodiments of the present disclosure. In some embodiments, the isolation sleeve 416 includes various flow control orifices 417*a*-417*d*. In some embodiments, the flow control orifices 417*a*-417*d* can be same or varying size orifices that allow a predetermined amount of flow or pressure drop therethrough. Therefore, as various flow control orifices 417*a*-417*d* are exposed to the window 120, a desired amount of flow is allowed through the window 120 while the isolation sleeve 416 is axially disposed across the window 120.

Figure 6:
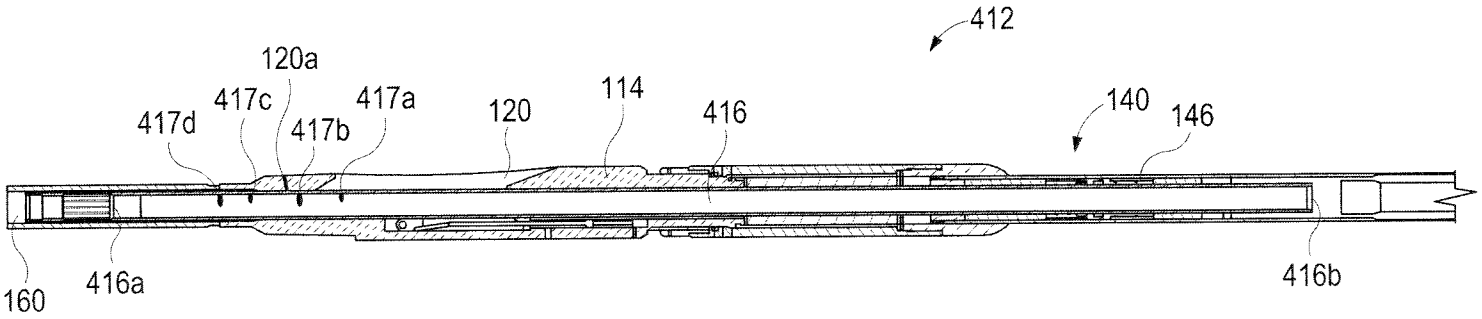
FIG. 6 is a cross-sectional side view of an exemplary reentry window assembly, according to some embodiments.

FIG. 6 is a cross-sectional side view of an exemplary reentry window assembly according to some embodiments of the present disclosure. In some embodiments, the actuator 140 can translate the isolation sleeve 416 to control flow through the window 120. By selectively translating the isolation sleeve 416, various flow control orifices 417*a*-417*d* are exposed to the window 120 allowing for varying amounts of flow therethrough. Further, the actuator 140 can translate the isolation sleeve 416 to move the upper end 416*a* of the isolation sleeve 416 downward past an upper end of the window 120 to partially or fully expose the window 120. In some embodiments, the actuator 140 can translate the upper end 416*a* past a flow control orifice 120*a* formed in the completion sleeve 114 to allow varying amounts of flow therethrough.

In addition to controlling flow via the actuator 140 in conjunction with the isolation sleeve 416*a*, a flow control valve 160 can be used to regulate flow passing through the wellbore system. The flow control device 160 can be controlled according to preprogrammed logic or an operator. In some embodiments, the use of the actuator 140 with the isolation sleeve 416*a* can be used in conjunction with the flow control valve 160. In some embodiments, the use of the actuator 140 with the isolation sleeve 416*a* can replace the use of the flow control valve 160. In some embodiments, the actuator 140 with the isolation sleeve 416*a* can be used for primary flow control purposes while the flow control valve 160 can be used for certain contingencies, including if control of the actuator 140 or the isolation sleeve 416*a* is compromised that places the isolation sleeve 416*a* in a "closed" or "emergency-close" position. In some embodiments, the flow control valve 160 can provide flow control operations when the isolation sleeve 416*a* is in such a closed position.

Various examples of aspects of the disclosure are described below as clauses for convenience. These are provided as examples, and do not limit the subject technology.

Clause 1. A lateral wellbore access system for moving an isolation sleeve relative to a window of a completion sleeve to adjust access through the window, comprising: an actuator having an isolation sleeve coupling mechanism and a driving mechanism, the isolation sleeve coupling mechanism configured to engage with an isolation sleeve, the driving mechanism configured to longitudinally reciprocate the isolation sleeve coupling mechanism within a bore of a completion sleeve to longitudinally move an isolation sleeve coupled to the isolation sleeve coupling mechanism within the bore relative to a window of the completion sleeve to adjust an amount of longitudinal overlap between the isolation sleeve and the completion sleeve window for permitting or blocking access through the window into the bore.

Clause 2. The system of Clause 1, further comprising a completion sleeve having a longitudinal axis, a bore, and a window extending at least partially along the longitudinal axis to provide access to the bore.

Clause 3. The system of any preceding Clause, further comprising an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore a first position, wherein the isolation sleeve occludes the window, and a second position, wherein the isolation sleeve is moved axially within the completion sleeve to expose the window.

Clause 4. The lateral wellbore access system of Clause 3, wherein the isolation sleeve comprise an upper seal to sealingly engage the completion sleeve uphole of the window when the isolation sleeve blocks access through the window into the bore.

Clause 5. The lateral wellbore access system of Clause 3, wherein the isolation sleeve comprises a lower seal to sealingly engage the completion sleeve downhole of the window when the isolation sleeve blocks access through the window into the bore.

Clause 6. The lateral wellbore access system of any preceding Clause, wherein the driving mechanism comprises a hydraulic driving mechanism.

Clause 7. The lateral wellbore access system of Clause 6, wherein the hydraulic driving mechanism comprises a piston coupled to the isolation sleeve coupling mechanism.

Clause 8. The lateral wellbore access system of Clause 7, wherein the piston is disposed within a chamber, the chamber being in fluid communication with a hydraulic pump for driving motion of the piston relative to the window.

Clause 9. The lateral wellbore access system of Clause 6, wherein the hydraulic actuator comprises a closed hydraulic system.

Clause 10. The lateral wellbore access system of any preceding Clause, further comprising a deflector disposed downhole of the window.

Clause 11. The lateral wellbore access system of any preceding Clause, wherein the isolation sleeve coupling mechanism comprises a latch key assembly.

Clause 12. The lateral wellbore access system of any preceding Clause, wherein when coupled to the completion sleeve, the actuator is disposed downhole of the isolation sleeve.

Clause 13. The lateral wellbore access system of any preceding Clause, wherein when coupled to the completion sleeve, the actuator is disposed uphole of the isolation sleeve.

Clause 14. A downhole apparatus, comprising: a completion sleeve having a longitudinal axis, a bore, and a window extending at least partially along the longitudinal axis to provide access to the bore; an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore; and an actuator operatively coupled to the isolation sleeve to longitudinally move the isolation sleeve within the bore.

Clause 15. The downhole apparatus of Clause 14, wherein the isolation sleeve is movable between a first position, wherein the isolation sleeve occludes the window, and a second position, wherein the isolation sleeve is moved axially within the completion sleeve to expose the window.

Clause 16. The downhole apparatus of Clause 15, wherein the isolation sleeve further comprises a flow control position between the first position and the second position, wherein in the flow control position the isolation sleeve is moved axially within the completion sleeve to partially expose the window.

Clause 17. The downhole apparatus of Clause 16, wherein the isolation sleeve further comprises a flow control orifice defining the flow control position.

Clause 18. The downhole apparatus of any one of Clauses 14-17, wherein the actuator is a hydraulic actuator.

Clause 19. The downhole apparatus of Clause 18, wherein the hydraulic actuator comprises a piston coupled to the isolation sleeve.

Clause 20. The downhole apparatus of Clause 19, wherein the piston is disposed within a chamber, the chamber being in fluid communication with a hydraulic pump for driving motion of the piston relative to the window.

The downhole apparatus of Clause 18, wherein the hydraulic actuator comprises a closed hydraulic system.

Clause 21. The downhole apparatus of any one of Clauses 14-20, wherein the isolation sleeve comprises an upper seal to sealingly engage the completion sleeve uphole of the window when the isolation sleeve is blocking access through the window into the bore.

Clause 22. The downhole apparatus of any one of Clauses 14-21, wherein the isolation sleeve comprises a lower seal to sealingly engage the completion sleeve downhole of the window when the isolation sleeve is blocking access through the window into the bore.

Clause 23. The downhole apparatus of any one of Clauses 14-22, further comprising a deflector.

Clause 24. The downhole apparatus of any one of Clauses 14-23, wherein the isolation sleeve is releasably coupled to the actuator.

Clause 25. The downhole apparatus of Clause 24, further comprising a latch key assembly releasably coupling the isolation sleeve and the actuator.

Clause 26. The downhole apparatus of Clause 24, wherein the isolation sleeve comprises a retrieval profile to engage a retrieval tool.

Clause 27. The downhole apparatus of any one of Clauses 14-26, wherein the actuator is disposed downhole of the isolation sleeve.

Clause 28. The downhole apparatus of any one of Clauses 14-26, wherein the actuator is disposed uphole of the isolation sleeve.

Clause 29. A well system, comprising: a primary wellbore lined with a casing that defines a casing exit; a secondary wellbore extending from the casing exit; and an isolation window assembly positioned within the primary wellbore, the isolation window including: a completion sleeve having a longitudinal axis, a bore, and a window extending at least partially along the longitudinal axis to provide access to the bore; an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore; and an actuator operatively coupled to the isolation sleeve to longitudinally move the isolation sleeve within the bore.

Clause 30. The well system of Clause 29, further comprising a flow control valve disposed within the primary wellbore.

Clause 31. The well system of Clause 29 or 30, wherein the isolation sleeve is movable between a first position, wherein the isolation sleeve occludes the window, and a second position, wherein the isolation sleeve is moved axially within the completion sleeve to expose the window.

Clause 32. The well system of Clause 31, wherein the isolation sleeve further comprises flow control positions between the first position and the second position, wherein in the flow control positions the isolation sleeve is moved axially within the completion sleeve to partially expose openings or orifices in the window.

Clause 33. The well system of Clause 32, wherein the isolation sleeve further comprises a flow control orifices defining the flow control positions.

Clause 34. The well system of any one of Clauses 29-33, wherein the actuator comprises a hydraulic actuator.

Clause 35. The well system of Clause 34, wherein the hydraulic actuator comprises a piston coupled to the isolation sleeve.

Clause 36. The well system of Clause 35, wherein the piston is disposed within a chamber, the chamber being in fluid communication with a hydraulic pump for driving motion of the piston relative to the window.

Clause 37. The well system of any one of Clauses 29-36, wherein the isolation sleeve comprises an upper seal to sealingly engage the completion sleeve uphole of the window when the isolation sleeve is blocking access and fluid flow (e.g. pressure) through the window into the bore.

Clause 38. The well system of any one of Clauses 29-37, wherein the isolation sleeve comprises a lower seal to sealingly engage the completion sleeve downhole of the window when the isolation sleeve is blocking access through the window into the bore.

Clause 39. The well system of any one of Clauses 29-38, further comprising a deflector disposed adjacent of the window opening.

Clause 40. The well system of any one of Clauses 29-39, wherein the isolation sleeve is releasably coupled to the actuator.

Clause 41. The well system of Clause 40, further comprising a fixedly releasable assembly releasably coupling the isolation sleeve and the actuator.

Clause 42. The well system of Clause 40, wherein the isolation sleeve comprises a retrieval profile to engage a retrieval tool.

Clause 43. The well system of any one of Clauses 29-42, wherein the actuator is disposed downhole of the isolation sleeve.

Clause 44. The well system of any one of Clauses 29-43, wherein the actuator is disposed uphole of the isolation sleeve.

Clause 45. A method, comprising: providing a casing that defines a casing exit and has a secondary wellbore extending from the casing exit; providing a completion sleeve having a longitudinal axis, a bore, and a window aligned with the casing exit, the window at least partially along the longitudinal axis to provide access to the bore; and moving an isolation sleeve axially within the completion sleeve to adjust an amount of longitudinal overlap between the isolation sleeve and the completion sleeve window for permitting or blocking access and pressure/fluid flow through the window into the bore via an actuator.

Clause 46. The method of Clause 45, wherein the actuator comprises a hydraulic actuator.

Clause 47. The method of Clause 46, wherein the hydraulic actuator comprises a piston coupled to the isolation sleeve.

Clause 48. The method of Clause 47, further comprising providing a first hydraulic pressure within a chamber, wherein the piston is disposed within the chamber, the chamber being in fluid communication with a hydraulic pump for driving motion of the piston relative to the window.

Clause 49. The method of Clause 47, wherein the hydraulic actuator comprises a closed hydraulic system.

Clause 50. The method of any one of Clauses 45-49, further comprising sealingly engaging the completion sleeve uphole of the window via an upper seal when the isolation sleeve is blocking access through the window into the bore.

Clause 51. The method of any one of Clauses 45-50, further comprising sealingly engaging the completion sleeve downhole of the window via a lower seal and sealingly engaging the completion sleeve uphole of the window via a upper seal when the isolation sleeve is blocking access through the window into the bore.

Clause 52. The method of any one of Clauses 45-51, further comprising deploying a deflector disposed adjacent of the window.

Clause 53. The method of any one of Clauses 45-52, further comprising releasing the isolation sleeve from the actuator.

Clause 54. The method of Clause 53, further comprising a fixedly releasable assembly releasably coupling the isolation sleeve and the actuator.

Clause 55. The method of Clause 53, further comprising engaging the isolation sleeve with a retrieval tool via a retrieval profile of the isolation sleeve.

Clause 56. The method of any one of Clauses 45-55, wherein the actuator is disposed downhole of the isolation sleeve.

Clause 57. The method of any one of Clauses 45-56, wherein the actuator is disposed uphole of the isolation sleeve.

Clause 58. A method, comprising: providing a completion sleeve in a primary wellbore lined with a casing that defines a casing exit and has a secondary wellbore extending from the casing exit, the completion sleeve having a longitudinal axis, a bore, and a window aligned with the casing exit, the window at least partially along the longitudinal axis to provide access to the bore; and moving an isolation sleeve axially within the completion sleeve to increase or decrease flow through the window via an actuator.

Clause 59. The method of Clause 58, wherein the isolation sleeve further comprises a flow control orifice to control the amount of flow.

Clause 60. The method of any one of Clauses 58 or 59, wherein the actuator comprises a hydraulic actuator.

Clause 61. The method of Clause 60, wherein the hydraulic actuator comprises a piston coupled to the isolation sleeve.

Clause 62. The method of Clause 61, further comprising providing a first hydraulic pressure in a chamber, wherein the piston is disposed within the chamber, the chamber being in fluid communication with a hydraulic pump for driving motion of the piston relative to the window.

Clause 63. The method of Clause 60, wherein the hydraulic actuator comprises a closed hydraulic system.

Clause 64. The method of any one of Clauses 58-63, further comprising sealingly engaging the completion sleeve uphole of the window via an upper seal of the isolation sleeve.

Clause 65. The method of any one of Clauses 58-64, further comprising sealingly engaging the completion sleeve downhole of the window via a lower seal of the isolation sleeve.

Clause 66. The method of any one of Clauses 58-65, further comprising releasing the isolation sleeve from the actuator.

Clause 67. The method of Clause 66, further comprising a latch key assembly releasably coupling the isolation sleeve and the actuator.

Clause 68. The method of Clause 66, further comprising engaging the isolation sleeve with a retrieval tool via a retrieval profile of the isolation sleeve.

Clause 69. The method of any one of Clauses 58-68, wherein the actuator is disposed downhole of the isolation sleeve.

Clause 70. The method of any one of Clauses 58-69, wherein the actuator is disposed uphole of the isolation sleeve.

What is claimed is:

1. A lateral wellbore access system for moving an isolation sleeve relative to a window of a completion sleeve to adjust access through the window, comprising:

an actuator comprising an isolation sleeve coupling mechanism and a driving mechanism, the isolation sleeve coupling mechanism releasably attached to the isolation sleeve, the driving mechanism configured to longitudinally reciprocate the isolation sleeve coupling mechanism within a bore of the completion sleeve to longitudinally move the isolation sleeve within the bore relative to the window of the completion sleeve to adjust a position of the isolation sleeve relative to the completion sleeve window for permitting or blocking access through the window into the bore, wherein the isolation sleeve is adjustable without manipulation from a surface tool, wherein the isolation sleeve comprises an outer profile operable to mate with the isolation sleeve coupling mechanism.

2. The system of claim 1, further comprising the completion sleeve having a longitudinal axis, the bore, and the window extending at least partially along the longitudinal axis to provide access to the bore.

3. The system of claim 1, further comprising the isolation sleeve positioned within the bore of the completion sleeve, the isolation sleeve being longitudinally movable within the bore to adjust the position of the isolation sleeve relative to the completion sleeve window for permitting or blocking access through the window into the bore a first position, wherein the isolation sleeve occludes the window, and a second position, wherein the isolation sleeve is moved axially within the completion sleeve to expose the window.

4. The lateral wellbore access system of claim 3, wherein the isolation sleeve comprises an upper seal.

5. The lateral wellbore access system of claim 4, wherein the isolation sleeve further comprises a lower seal to sealingly engage the completion sleeve up-hole and downhole of the window when the isolation sleeve blocks access through the window into the bore.

6. The lateral wellbore access system of claim 1, wherein the isolation sleeve is removable from a well.

7. The lateral wellbore access system of claim 1, wherein the isolation sleeve coupling mechanism is operable to bypass other sleeves that do not match a pattern of the outer profile.

8. The lateral wellbore access system of claim 1, wherein when coupled to the completion sleeve, the actuator is disposed downhole of the isolation sleeve.

9. The lateral wellbore access system of claim 1, wherein when coupled to the completion sleeve, the actuator is disposed uphole of the isolation sleeve.

10. A well system comprising:

a primary wellbore that defines a casing exit;

a secondary wellbore extending from the casing exit; and an isolation window assembly positioned within the primary wellbore, the isolation window including:

a completion sleeve having a longitudinal axis, a bore, and a window extending at least partially along the longitudinal axis to provide access to the bore;

an isolation sleeve positioned within the bore of the completion sleeve, the isolation sleeve being longitudinally movable within the bore to adjust a position of the isolation sleeve relative to the completion sleeve window for permitting or blocking access through the window into the bore;

an actuator operatively coupled to the isolation sleeve to longitudinally move the isolation sleeve within the bore, the actuator comprising a piston, wherein the isolation sleeve is releasably attached to the actuator via the isolation sleeve coupling mechanism, wherein the isolation sleeve is adjustable without manipulation from a surface tool, wherein the isolation sleeve comprises an outer profile operable to mate with the isolation sleeve coupling mechanism.

11. The well system of claim 10, further comprising a flow control valve disposed within the primary wellbore.

12. The well system of claim 10, wherein the isolation sleeve is movable between a first position, wherein the isolation sleeve occludes the window, and a second position, wherein the isolation sleeve is moved axially within the completion sleeve to expose the window.

13. The well system of claim 12, wherein the isolation sleeve further comprises a flow control position between the first position and the second position, wherein in the flow control position the isolation sleeve is moved axially within the completion sleeve to partially expose the window.

14. The well system of claim 13, wherein the isolation sleeve further comprises a flow control orifice defining the flow control position.

15. The well system of claim 14, wherein the completion sleeve further comprises a flow control orifice defining the flow control position.

16. A method comprising:

providing a casing that defines a casing exit and has a secondary wellbore extending from the casing exit;

providing a completion sleeve having a longitudinal axis, a bore, and a window aligned with the casing exit, the window at least partially along the longitudinal axis to provide access to the bore;

moving an isolation sleeve axially within the completion sleeve to adjust a position of the isolation sleeve relative to the completion sleeve window for permitting or blocking access through the window into the bore via an actuator disposed within the wellbore, wherein the isolation sleeve is releasably attached to the actuator via the isolation sleeve coupling mechanism;

adjusting the isolation sleeve without manipulation from a surface tool; and mating an outer profile of the isolation sleeve to the isolation sleeve coupling mechanism of the actuator.

17. The method of claim 16, further comprising exposing flow control orifices, of the isolation sleeve, to the window.

18. The method of claim 16, further comprising disengaging the outer profile of the isolation sleeve from the isolation sleeve coupling mechanism.

19. The method of claim 16, further comprising bypassing, with the isolation sleeve coupling mechanism, other sleeves that do not match a pattern of the outer profile.

20. The method of claim 16, further comprising releasing the isolation sleeve from the actuator.

* * * * *